US009970369B2

(12) United States Patent
Takahashi et al.

(10) Patent No.: US 9,970,369 B2
(45) Date of Patent: May 15, 2018

(54) CONTROL DEVICE AND METHOD FOR INTERNAL COMBUSTION ENGINE

(71) Applicant: MITSUBISHI ELECTRIC CORPORATION, Chiyoda-ku, Tokyo (JP)

(72) Inventors: Shingo Takahashi, Chiyoda-ku (JP); Masahiko Nomura, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 1212 days.

(21) Appl. No.: 13/927,909

(22) Filed: Jun. 26, 2013

(65) Prior Publication Data

US 2014/0109869 A1 Apr. 24, 2014

(30) Foreign Application Priority Data

Oct. 24, 2012 (JP) ..... 2012-234451

(51) Int. Cl.

*F02D 41/00* (2006.01)
*F02D 31/00* (2006.01)
*F02D 41/14* (2006.01)

(52) U.S. Cl.

CPC ..... *F02D 41/0082* (2013.01); *F02D 31/003* (2013.01); *F02D 41/008* (2013.01); (Continued)

(58) Field of Classification Search

CPC ..... F02D 2041/1422; F02D 2041/0082; F02D 2041/008; F02D 41/008; F02D 41/0082; (Continued)

(56) References Cited

U.S. PATENT DOCUMENTS 4,667,634 A * 5/1987 Matsumura ..... F02D 41/0085 123/357
4,762,462 A * 8/1988 Lardellier ..... F01D 9/041 415/139

(Continued)

FOREIGN PATENT DOCUMENTS

DE 3913523 A1 * 11/1989
EP 1548252 A1 * 6/2005 ..... F02D 9/1065

(Continued)

*Primary Examiner* — Mahmoud Gimie
*Assistant Examiner* — Josh Campbell
(74) *Attorney, Agent, or Firm* — Sughrue Mion, PLLC; Richard C. Turner

(57) ABSTRACT

Provided is a control unit (1) for setting, for respective electronic throttles (11) and (12) provided for respective cylinders, respective ranges of a difference between a target rpm and an engine rpm where the electronic throttles (11) and (12) are not operated as a first dead zone and a second dead zone, determining, for each of the electronic throttles (11) and (12), whether or not the difference between the target rpm and the engine rpm is in the dead zone, preventing the electronic throttle determined to have the difference in the dead zone from operating, and determining, for the electronic throttle determined to have the difference exceeding the dead zone, a control gain for the electronic throttle depending on the magnitude of the difference, thereby operating the electronic throttle.

8 Claims, 4 Drawing Sheets

(52) U.S. Cl.
CPC ..... *F02D 41/0085* (2013.01); *F02D 41/0087* (2013.01); *F02D 2041/1422* (2013.01)

(58) Field of Classification Search
CPC . F02D 41/0085; F02D 41/0087; F02D 31/003
USPC ..... 123/350, 336, 436
See application file for complete search history.

(56) References Cited

U.S. PATENT DOCUMENTS 4,785,780 A * 11/1988 Kawai ..... F02D 31/003 123/339.2
5,117,793 A * 6/1992 Taue ..... F02D 41/1498 123/436
5,121,724 A * 6/1992 Anzai ..... F02D 31/005 123/336
5,515,828 A * 5/1996 Cook ..... F02D 13/0203 123/436
5,775,299 A * 7/1998 Ito ..... F02D 41/1498 123/406.24
6,019,085 A * 2/2000 Sato ..... F02D 11/105 123/339.19
6,273,062 B1 * 8/2001 Bayerl ..... F02D 41/0002 123/336
7,520,263 B1 * 4/2009 Kim ..... F02D 31/003 123/339.1
2003/0062019 A1 * 4/2003 Schaefer-Siebert ..... F02D 9/02 123/198 F
2006/0225698 A1 * 10/2006 Nogi ..... F01L 9/04 123/336
2008/0287254 A1 * 11/2008 Nagai ..... F02D 41/023 477/102

FOREIGN PATENT DOCUMENTS

JP 2012-19371 * 10/2012
WO 2004/025103 A1 3/2004

* cited by examiner

CONTROL DEVICE AND METHOD FOR INTERNAL COMBUSTION ENGINE

BACKGROUND OF THE INVENTION

1. Field of the Invention

The present invention relates to a control device and method for an internal combustion engine, and more particularly, to a control device and method for an internal combustion engine for controlling an rpm (rotation per minute or revolution per minute) of an internal combustion engine including a plurality of cylinders and independently controllable electronic throttles for the respective cylinders.

2. Description of the Related Art

There has been known a system for using, in an intake passage for leading the air to respective cylinders, independently controllable electronic throttles for the respective cylinders to provide such control that an opening degree of the electronic throttle for one cylinder is constant, and the electronic throttle for the other cylinder alone is operated, thereby restraining an increase in air amount to be minimum (for example, refer to International Patent WO2004/025103A).

According to the related art described in International Patent WO2004/025103A, there is described such a configuration that, in order to control an idle rpm, an opening degree of the electronic throttle for the one cylinder is kept to be constant so that the influence caused by the increase in air amount supplied to the engine can be restrained to be minimum. However, in a state where the rpm of the internal combustion engine is greatly different from the target rpm, the control of the intake air amount only by the electronic throttle for the one cylinder causes such a problem that it takes a time until the rpm converges to the target rpm, which results in a slow response.

SUMMARY OF THE INVENTION

The present invention has been made in view of the above-mentioned problem, and therefore has an object to provide a control device and method for an internal combustion engine capable of responsively converging, in an internal combustion engine including a plurality of cylinders and independently controllable electronic throttles for the respective cylinders, an rpm to a target rpm, and stably maintaining the target rpm.

According to an exemplary embodiment of the present invention, there is provided a control device for an internal combustion engine for controlling an engine rpm of the internal combustion engine, the internal combustion engine including a plurality of cylinders, and electronic throttles which are provided for the respective plurality of cylinders, and are configured to control intake air amounts independently for the respective plurality of cylinders, the control device including: engine rpm detection means for detecting the engine rpm of the internal combustion engine; target rpm setting means for setting a target rpm based on an operation state of a vehicle including the internal combustion engine; difference detection means for detecting a difference between the target rpm and the engine rpm of the internal combustion engine; and control means for independently controlling the plurality of electronic throttles based on a magnitude of the difference, thereby increasing/decreasing an intake air amount so that the target rpm and the engine rpm of the internal combustion engine match each other. The control means is configured to: set, to each of a plurality of the electronic throttles, a range of the difference where the each of the plurality of the electronic throttles is prevented from being operated as a dead zone of the each of the plurality of the electronic throttles; determine, for the each of the plurality of the electronic throttles, whether or not the difference detected by the difference detection means is in the dead zone; prevent one of the plurality of the electronic throttles determined to have the difference in the dead zone from operating; and determine, for one of the plurality of the electronic throttles determined to have the difference exceeding the dead zone, a control gain for the one of the plurality of the electronic throttles depending on the magnitude of the difference detected by the difference detection means, thereby operating the one of the plurality of the electronic throttles.

The exemplary embodiment of the present invention provides the control device for an internal combustion engine for controlling the engine rpm of the internal combustion engine, the internal combustion engine including the plurality of cylinders, and the electronic throttles which are provided for the respective plurality of cylinders, and are configured to control the intake air amounts independently for the respective plurality of cylinders, the control device including: the engine rpm detection means for detecting the engine rpm of the internal combustion engine; the target rpm setting means for setting the target rpm based on the operation state of the vehicle including the internal combustion engine; the difference detection means for detecting the difference between the target rpm and the engine rpm of the internal combustion engine; and the control means for independently controlling the plurality of electronic throttles based on the magnitude of the difference, thereby increasing/decreasing the intake air amount so that the target rpm and the engine rpm of the internal combustion engine match each other. The control means is configured to: set, to the each of the plurality of the electronic throttles, the range of the difference where the each of the plurality of the electronic throttles is prevented from being operated as the dead zone of the each of the plurality of the electronic throttles; determine, for the each of the plurality of the electronic throttles, whether or not the difference detected by the difference detection means is in the dead zone; prevent the one of the plurality of the electronic throttles determined to have the difference in the dead zone from operating; and determine, for the one of the plurality of the electronic throttles determined to have the difference exceeding the dead zone, the control gain for the one of the plurality of the electronic throttles depending on the magnitude of the difference detected by the difference detection means, thereby operating the one of the plurality of the electronic throttles. Therefore, in the internal combustion engine including the plurality of cylinders and the independently controllable electronic throttles for the respective cylinders, it is possible to responsively converge the rpm to the target rpm, and stably maintain the target rpm.

DETAILED DESCRIPTION OF THE PREFERRED EMBODIMENT

First Embodiment

Figure 1:
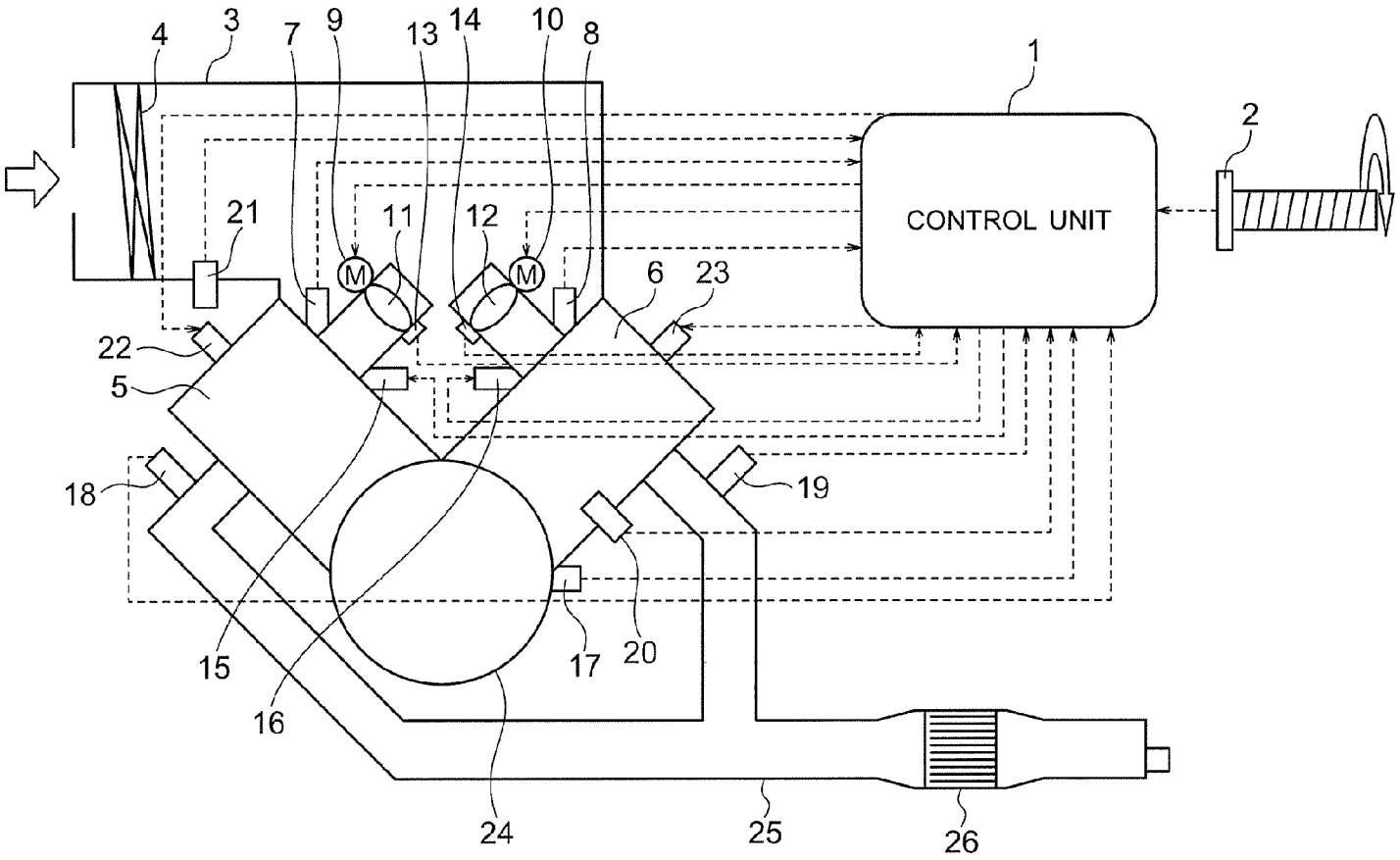
FIG. 1 illustrates a system configuration of an engine including an engine control device for a motor cycle according to a first embodiment of the present invention.

A detailed description is now given of a control device for an internal combustion engine according to an embodiment of the present invention referring to the drawings. FIG. 1 illustrates a V-twin engine as an example of an internal combustion engine subject to control of the control device for an internal combustion engine according to a first embodiment of the present invention.

In the internal combustion engine subject to the control of the control device for an internal combustion engine according to the first embodiment of the present invention, as illustrated in FIG. 1, an engine (internal combustion engine) 24 is connected to an intake system for taking in engine intake air through an air cleaner box 3, and is connected to an exhaust system 25 for exhausting an exhaust gas through exhaust valves. In the air cleaner box 3, an air filter 4 for cleaning the engine intake air, and an intake air temperature sensor 21 for measuring the temperature of the engine intake air are provided. Moreover, in the exhaust system 25, a three-way catalyst 26 for cleaning the exhaust gas, and $O_2$ sensors 18 and 19 for detecting oxygen densities in the exhaust gas for the respective cylinders so as to control an air fuel ratio are provided.

The engine 24 of FIG. 1 includes two cylinders 5 and 6 (first cylinder and second cylinder). Each of the cylinders 5 and 6 includes an intake pipe and an exhaust pipe for communicating with each of the cylinders 5 and 6. On the intake pipes respectively communicating with the cylinders 5 and 6, there are provided electronic throttles 11 and 12 for controlling intake air amounts which are independently controllable by a control unit 1, electronic throttle control motors 9 and 10 for controlling the electronic throttles 11 and 12, throttle position sensors 13 and 14 for measuring opening degrees of throttle valves of the electronic throttles 11 and 12, intake air pressure sensors 7 and 8 for measuring an intake air pressure downstream of the throttle valves of the electronic throttles 11 and 12, and injectors (fuel injection devices) 15 and 16 for injecting a fuel into the engine intake air, thereby generating a fuel-air mixture. Moreover, the respective cylinders 5 and 6 include ignition plugs 22 and 23 driven by ignition coils. Moreover, the cylinder 6 includes a water temperature sensor 20 for measuring a wall surface temperature of the engine to measure a temperature of coolant for the engine, and a crank angle sensor 17 for measuring a position of a crankshaft.

Moreover, a vehicle (not shown) including the internal combustion engine of FIG. 1 includes an accelerator grip, and also includes an accelerator position sensor 2 for measuring the position of an accelerator opening degree, thereby detecting an operation amount of the accelerator grip operated by a driver of the vehicle.

Moreover, the internal combustion engine of FIG. 1 includes a control unit (ECU) 1. The control unit 1 stores, in the memory, a program and map for controlling an operation of the entire engine. The control unit 1 receives information input from (at least one of) the intake air temperature sensor 21, the throttle position sensors 13 and 14, the accelerator position sensor 2, the intake air pressure sensors 7 and 8, the water temperature sensor 20, the crank angle sensor 17, and the $O_2$ sensors 18 and 19, calculates appropriate fuel injection timings and fuel injection amounts based on the information, and outputs drive signals to the injectors 15 and 16 which are fuel injection devices.

Based on the information input from (at least one of) the intake air temperature sensor 21, the throttle position sensors 13 and 14, the accelerator position sensor 2, the intake air pressure sensors 7 and 8, the water temperature sensor 20, the crank angle sensor 17, and the $O_2$ sensors 18 and 19, the control unit 1 outputs ignition signals at proper timings to the ignition coils, thereby generating sparks on the ignition plugs 22 and 23. As a result, the air-fuel mixture in combustion chambers of the respective cylinders 5 and 6 is combusted, thereby pushing pistons provided for the respective cylinders 5 and 6, and rotating the crankshaft connected to the pistons.

Further, based on an operation state of the vehicle based on the information input from (at least one of) the intake air temperature sensor 21, the throttle position sensors 13 and 14, the accelerator position sensor 2, the intake air pressure sensors 7 and 8, the water temperature sensor 20, the crank angle sensor 17, and the $O_2$ sensors 18 and 19, the control unit 1 sets a target rpm of the internal combustion engine. Moreover, the control unit 1 acquires the engine rpm of the internal combustion engine based on information from the crank angle sensor 17 which is detection means for detecting the engine rpm of the internal combustion engine. Then, the control unit 1 detects the difference between the target rpm and the engine rpm of the internal combustion engine, and drives the electronic throttle control motors 9 and 10 to control the electronic throttles 11 and 12, thereby increasing/decreasing the intake air amount so that the target rpm and the engine rpm match each other. The control unit 1 sets, for the control, an increment amount or decrement amount in the intake air amount as a control gain depending on the difference. Moreover, the control unit 1 sets a plurality of ranges of the difference as dead zones for stopping the operation of the electronic throttles 11 and 12. According to the first embodiment, the dead zones are set to the electronic throttles 11 and 12 respectively so that the dead zones are different from one another in size.

Figure 2:
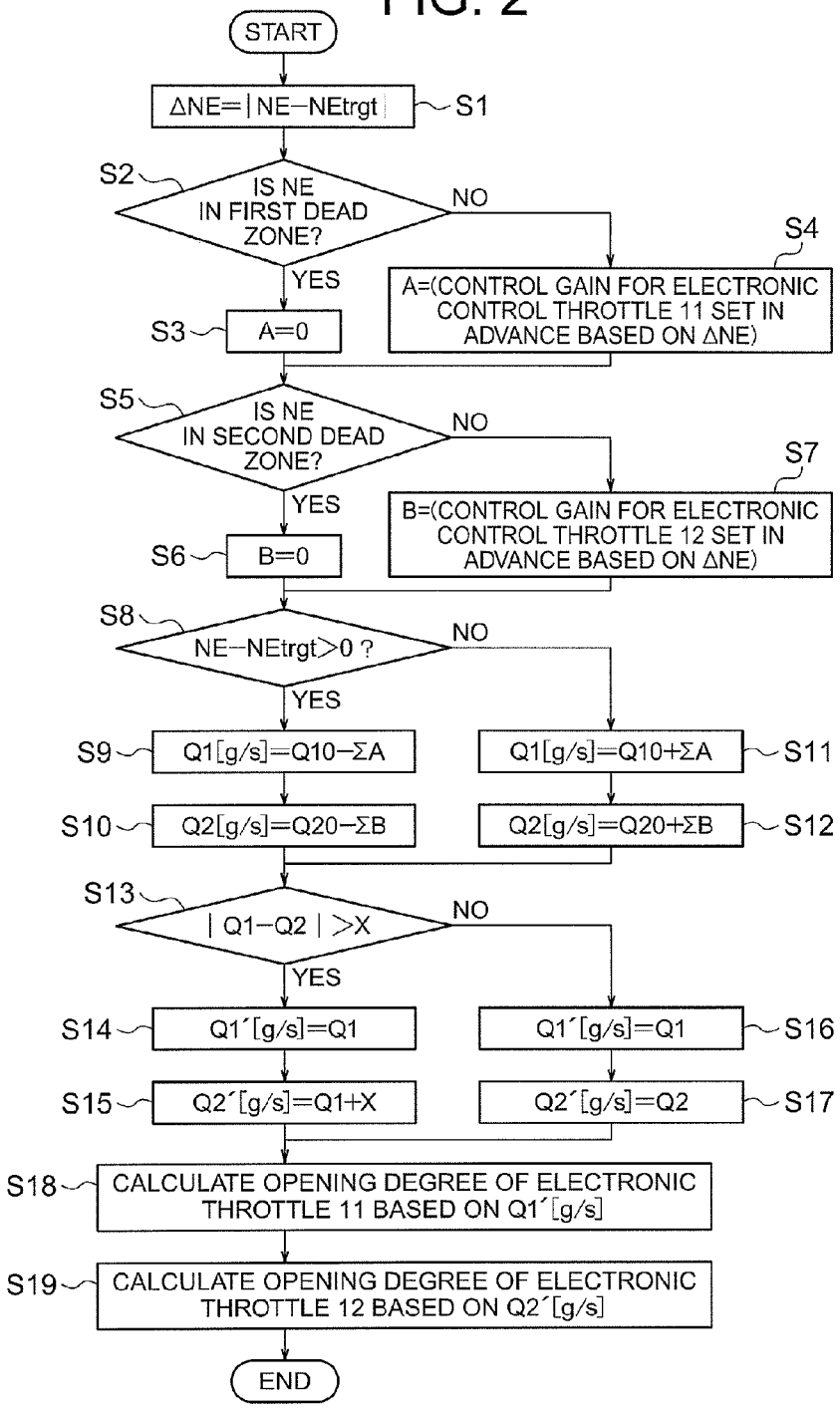
FIG. 2 is a flowchart illustrating a flow of processing by the control device for an internal combustion engine according to the first embodiment of the present invention.
Figure 3:
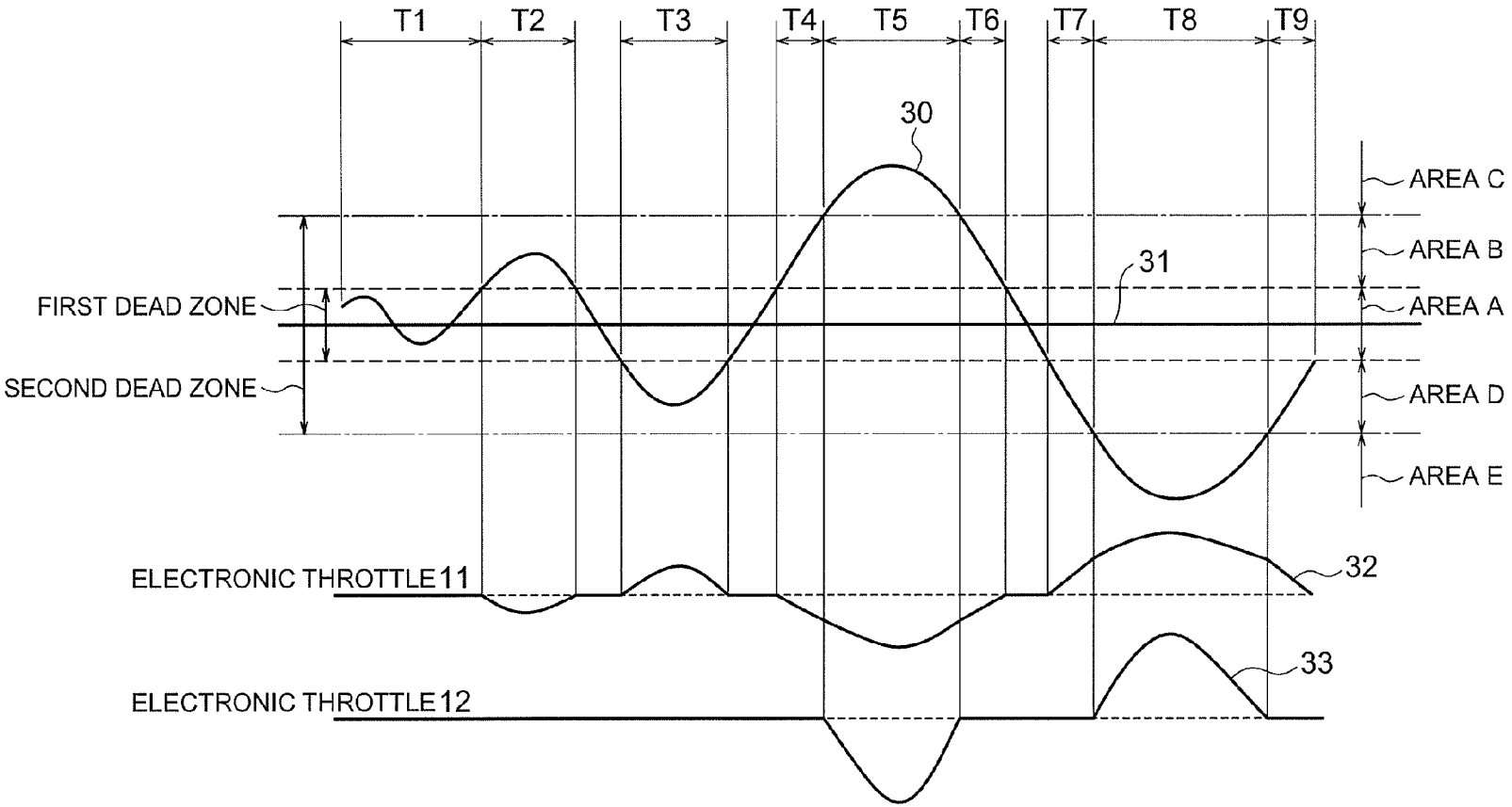
FIG. 3 is a diagram showing a relationship between a target idle rpm and first and second dead zones in the control device for an internal combustion engine according to the first embodiment of the present invention.

A description is now given of a method of controlling the engine rpm to reach the target rpm in the control device according to the first embodiment. On this occasion, a description is given by taking, as an example of the target rpm, the target rpm (hereinafter referred to as target idle rpm) in an idle state (idling state) of the vehicle. FIG. 2 is a flowchart for processing of the control unit 1 to control the engine rpm to reach the target idle rpm. Moreover, the engine rpm is controlled by setting a first dead zone and a second dead zone as shown in FIG. 3. It should be noted that both the first dead zone and the second dead zone are predetermined ranges of the rpm whose centers are the target idle rpm (NEtrgt), and the second dead zone is wider than the first dead zone. when both the difference between an upper limit value of the first dead zone and the target idle rpm (NEtrgt) and the difference between an lower limit value of the first dead zone and the target idle rpm (NEtrgt) are supposed to a first predetermined value, and both the difference between an upper limit value of the second dead zone and the target idle rpm (NEtrgt) and the difference between an lower limit value of the second dead zone and the target idle rpm (NEtrgt) are supposed to a second predetermined value, the first predetermined value is smaller than the second predetermined value. It should be noted that the first dead zone is a range of the engine rpm where the electronic throttle 11 does not operate, and the second dead zone is a range of the engine rpm where the electronic throttle 12 does not operate. In this way, the respective dead zones are set to the respective electronic throttles 11 and 12.

As illustrated in the flowchart of FIG. 2, first, the control unit 1 calculates the engine rpm (NE) based on the information acquired from the crank angle sensor 17. Then, in Step S1, the control unit 1 calculates the difference (ΔNE=|NE−NEtrgt|) between the engine rpm (NE) and the target idle rpm (NEtrgt).

Then, in Step S2, the control unit 1 determines whether or not the engine rpm (NE) exists in the first dead zone. If the control unit 1 determines that the engine rpm (NE) exists in the first dead zone, the processing proceeds to Step S3 so as to prevent the electronic throttle 11 from operating. In Step S3, the control unit 1 sets a control gain (A) for the electronic throttle 11 to 0 [g/s/s] (A=0 [g/s/s]). On the other hand, in Step S2, if the control unit 1 determines that the engine rpm (NE) does not exist in the first dead zone, the processing proceeds to Step S4 so as to operate the electronic throttle 11. In Step S4, the control unit 1 uses a map of FIG. 5 to acquire the control gain (A) for the electronic throttle 11 based on the difference (ΔNE) acquired in Step S1.

Figure 5:
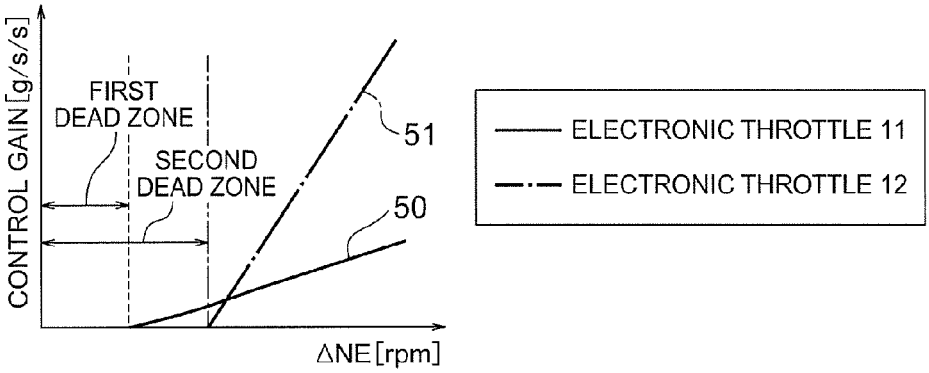
FIG. 5 is a diagram showing control gains in the control device for an internal combustion engine according to the first embodiment of the present invention.

It should be noted that, in the map of FIG. 5, as indicated by a solid line 50, the value of the control gain (A) for the electronic throttle 11 is set in advance for respective values of the difference (ΔNE). Moreover, similarly, in the map of FIG. 5, as indicated by a long dashed short dashed line 51, the value of a control gain (B) for the electronic throttle 12 is set in advance for respective values of the difference (ΔNE). As shown in FIG. 5, according to the first embodiment, the value of the control gain (long dashed short dashed line 51) for the electronic throttle 12 is set to be larger than the value of the control gain (solid line 50) for the electronic throttle 11.

After the processing in Step S3 or Step S4 is finished, the processing proceeds to Step S5.

Then, in Step S5, the control unit 1 determines whether or not the engine rpm (NE) exists in the second dead zone. If the control unit 1 determines that the engine rpm (NE) exists in the second dead zone, the processing proceeds to Step S6 so as to prevent the electronic throttle 12 from operating. In Step S6, the control unit 1 sets the control gain (B) for the electronic throttle 12 to 0 [g/s/s] (B=0 [g/s/s]). On the other hand, in Step S5, if the control unit 1 determines that the engine rpm (NE) does not exist in the second dead zone, the processing proceeds to Step S7 so as to operate the electronic throttle 12. In Step S7, the control unit 1 uses the map of FIG. 5 to acquire the control gain (B) for the electronic throttle 12 based on the difference (ΔNE) acquired in Step S1.

After the processing in Step S6 or Step S7 is finished, the processing proceeds to Step S8.

In Step S8, the control unit 1 determines whether the difference (NE−NEtrgt) acquired by subtracting the target idle rpm (NEtrgt) from the engine rpm (NE) is positive or negative. If the control unit 1 determines that the difference (NE−NEtrgt) is positive, the processing proceeds to Step S9. In Step S9, the control unit 1 acquires a value (ΣA) by summing the control gain (A) for the electronic throttle 11 in each control period, and subtracts the value (ΣA) from a current intake air amount Q10 for the cylinder 1 (reference numeral 5) to acquire a target intake air amount Q1 (Q1=Q10−ΣA) for the cylinder 1 (reference numeral 5). Then, similarly, in Step S10, the control unit 1 acquires a value (SB) by summing the control gain (B) for the electronic throttle 12 in each control period, and subtracts the value (ΣB) from a current intake air amount Q20 for the cylinder 2 (reference numeral 6) to acquire a target intake air amount Q2 (Q2=Q20−ΣB) for the cylinder 2 (reference numeral 6).

On the other hand, in Step S8, if the control unit 1 determines that the difference (NE−NEtrgt) is negative, the processing proceeds to Step S11. In Step S11, the control unit 1 acquires the value (ΣA) by summing the control gain (A) for the electronic throttle 11 in each control period, and adds the value (ΣA) to the current intake air amount Q10 for the cylinder 1 (reference numeral 5) to acquire the target intake air amount Q1 (Q1=Q10+ΣA) for the cylinder 1 (reference numeral 5). Then, similarly, in Step S12, the control unit 1 acquires the value (ΣB) by summing the control gain (B) for the electronic throttle 12 in each control period, and adds the value (ΣB) to the current intake air amount Q20 for the cylinder 2 (reference numeral 6) to acquire the target intake air amount Q2 (Q2=Q20+ΣB) for the cylinder 2 (reference numeral 6).

After the processing in Step S10 or Step S12 is finished, the processing proceeds to Step S13.

Figure 6:
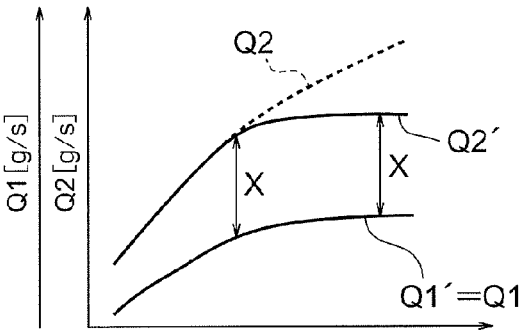
FIG. 6 is a diagram showing a case where an intake air amount is restricted in the control device for an internal combustion engine according to the first embodiment of the present invention.

In Step S13, the control unit 1 determines whether or not a difference between the target intake air amount (Q1) to be taken into the cylinder 1 and the target intake air amount (Q2) to be taken into the cylinder 2 exceeds a predetermined value (X) set in advance (|Q1−Q2|>X). If the difference exceeds the predetermined value (X), the difference between the intake air amounts to be taken into the cylinder 1 (reference numeral 5) and the cylinder 2 (reference numeral 6) is large, and a balance of the engine as a whole thus deteriorates, which causes a decrease in drivability such as vibration. Thus, in Step S13, if the control unit 1 determines that the difference exceeds the predetermined value (X), the processing proceeds to Step S14. In Step S14, as shown in FIG. 6, the control unit 1 sets a target intake air amount Q1' for the cylinder 1 to Q1 acquired in Step S9 or Step S11 (Q1'=Q1), and, in Step S15, sets a target intake air amount Q2' for the cylinder 2 to a value acquired by adding the predetermined value (X) to Q1 (Q2'=Q1+X), thereby restraining the target intake air amount Q2' from excessively increasing. On the other hand, in Step S13, if the control unit 1 determines that the difference does not exceed the predetermined value (X), the control unit 1 directly uses the target intake air amounts Q1 and Q2 acquired in Steps S9 and S10 or S11 and S12, and sets the target intake air amount Q1' for the cylinder 1 and the target intake air amount Q2' for the cylinder 2 as Q1'=Q1 and Q2'=Q2, respectively.

In this way, according to the first embodiment, in Steps S9 and S10 or Steps S11 and S12, the control unit 1 sets, based on the control gains, the target values Q1 and Q2 of the target intake air amounts which are independently controlled by the electronic throttles 11 and 12, and then, in Step S13, determines whether or not the difference (|Q1−Q2|) between the target intake air amounts exceeds the predetermined value (X). If the difference exceeds the predetermined value (X), in Steps S14 and S15, the control unit 1 sets again the value of the target intake air amounts so as to prevent the difference from exceeding the predetermined value (X).

After the processing in Step S15 or Step S17 is finished, the processing proceeds to Step S18.

In Step S18, the control unit 1 determines the opening degree of the electronic throttle 11 based on the target air intake amount Q1' finally acquired in Step S14 or S16.

Moreover, in Step S19, the control unit 1 determines the opening degree of the electronic throttle 12 based on the target air intake amount Q2' finally acquired in Step S15 or S17.

Figure 4:
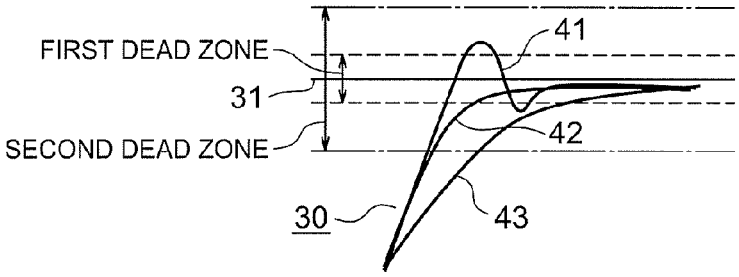
FIG. 4 is a diagram showing an effect by the control device for an internal combustion engine according to the first embodiment of the present invention.

A description is now given of effects of the first embodiment referring to FIGS. 3 and 4. In FIGS. 3 and 4, vertical axes represent the engine rpm, and horizontal axes represent time. In FIGS. 3 and 4, reference numerals 30 and 31 respectively denote the engine rpm (NE), and the target idle rpm (NEtrgt). Moreover, in FIG. 3, T1 to T9 respectively represent time ranges. Reference numeral 32 denotes a graph representing the opening degree of the throttle valve of the electronic throttle 11. Reference numeral 33 denotes a graph representing the opening degree of the throttle valve of the electronic throttle 12. Moreover, an area A represents the same range as the first dead zone, areas B and D represent ranges acquired by removing the first dead zone from the second dead zone, the area B represents an area where the engine rpm is high, and the area D represents an area where the engine rpm is low. Areas C and E represent ranges where the engine rpm exceeds the second dead zone, the area C represents an area where the engine rpm is high, and the area E represents an area where the engine rpm is low. Moreover, FIG. 4 shows a case where control is carried out in order to converge the engine rpm (NE) to the target idle rpm when the engine rpm (NE) decreases to an engine rpm greatly lower than the target idle rpm (NEtrgt). In FIG. 4, reference numeral 41 denotes a case where all the cylinders are controlled by using the same control gains and the same dead zones, reference numeral 42 denotes a case where all the cylinders have independent dead zones and are controlled by using independent control gains, and reference numeral 43 denotes a case where the opening degree of one of the cylinders is fixed.

In FIG. 3, if the engine rpm exists in the area A of FIG. 3, namely, in the time range T1, as represented by the graphs 32 and 33, the electronic throttles 11 and 12 are not operated, and the current opening degrees are maintained. The engine rpm exists close to the target idle rpm, and stability is maintained by maintaining the current opening degrees. It should be noted that the same holds true for, not only the time range T1, but also a time range between T2 and T3, a time range between T3 and T4, and a time range between T6 and T7.

Then, when the engine rpm exists in the areas B and D (when the engine rpm does not exist in the first dead zone, but in the second dead zone), namely in the time ranges T2 and T3, as represented by the graphs 32 and 33, only the electronic throttle 11 is operated, and the electronic throttle 12 is not operated. It should be noted that, on this occasion, the control gain for the electronic throttle 11 is the control gain (A) determined in Step S4 of FIG. 2. As a result, compared with the case where the control is provided by operating the electronic throttles 11 and 12 for both the cylinders, a control resolution for the intake air amount can be set to be high, and hence more appropriate control for the intake air amount taken into the engine can be provided, and stable control can be carried out.

Moreover, when the engine rpm exists in the areas C and E (when the engine rpm does not exist in the second dead zone), namely, in the time ranges T5 and T8, the electronic throttle 11 operates based on the control gain (A) determined in Step S4 of FIG. 2, and the electronic throttle 12 operates based on the control gain (B) determined in Step S7 of FIG. 2. The second dead zone is set to be larger than the first dead zone, and hence in a case where the difference between the engine rpm and the target rpm is large as in the areas C and E, both the electronic throttles 11 and 12 operate so that the responsiveness is improved compared with the control where the opening degree of one of the electronic throttles is maintained to be fixed. The graphs of FIG. 4 represent this case. As described above, in FIG. 4, reference numeral 41 denotes the case where all the cylinders are controlled by using the same control gains and the same dead zones, reference numeral 42 denotes the case where all the cylinders have the independent dead zones and are controlled by using the independent control gains (namely, the case of the first embodiment), and reference numeral 43 denotes the case where the opening degree of one of the cylinders is fixed. By comparing the cases 41 and 42 where all the cylinders are operated and the case 43 where only one of the cylinders is operated with each other, it is appreciated that the cases 41 and 42 are shorter in time until the rpm converges to a neighborhood of the target idle rpm (NEtrgt), and are more excellent in responsiveness than the case 43. Thus, when the difference between the engine rpm and the target rpm is large, it is appreciated that it is more advantageous to operate all the cylinders. Further, by comparing the cases 41 and 42 of FIG. 4, it is appreciated that the case 42 corresponding to the first embodiment is shorter in time until the rpm converges to a neighborhood of the target idle rpm (NEtrgt), is more excellent in responsiveness, is smoother in change of the engine rpm (NE), and is thus more excellent in stability than the case 41. Thus, according to the first embodiment, by providing the control having the independent dead zones for the respective cylinders, and using the independent control gains, the excellent responsiveness and the stability are realized. Moreover, according to the first embodiment, if the engine rpm exists in the area B or D lower or upper than the area C or E (when the engine rpm does not exist in the first dead zone, but in the second dead zone), namely in the time ranges T4, T6, T7, and T9, only the electronic throttle 11 operates based on the control gain (A), and the electronic throttle 12 does not operate, and hence the resolution of the electronic throttle with respect to the intake air amount can be set to be high, and, compared with the case where both the cylinders operate, the convergence to the target rpms becomes better, and stable control is thus provided. Further, in this case, one (in this case, the electronic throttle 12) of the electronic throttles is not operated, and hence an effect of reducing power consumption is also provided.

As described above, according to the first embodiment, the control unit 1 includes engine rpm detection means for detecting the engine rpm of the internal combustion engine, target rpm setting means for setting a target rpm based on an operation state of a vehicle including the internal combustion engine, difference detection means for detecting a difference between the target rpm and the engine rpm of the internal combustion engine, and control means for independently controlling the electronic throttles based on a magnitude of the difference, thereby increasing/decreasing an intake air amount so that the target rpm and the engine rpm of the internal combustion engine match each other. The control means sets, to each of the plurality of electronic throttles, a range of the difference where each of the plurality of electronic throttles is not operated as a dead zone of each thereof. The control means determines, for each of the plurality of electronic throttles, whether or not the difference detected by the difference detection means is in the dead zone. If the control means determines that the electronic throttle has the difference in the dead zone, the control means prevents the electronic throttle from operating. On the other hand, if the control means determines that the electronic throttle has the difference exceeding the dead zone, the control means determines a control gain for the electronic throttle depending on the magnitude of the difference detected by the difference detection means, thereby operating the electronic throttle. In this way, there is provided such a configuration that the dead zone is provided for the electronic throttle for each of the cylinders, and the electronic throttle to be operated is determined depending on the difference. According to the first embodiment, compared with a case where the electronic throttles for all the cylinders are simultaneously controlled, the intake air amount can be more finely controlled, and the engine rpm can be stably controlled. Moreover, when the difference is large, the electronic throttles for all the cylinders are operated. Then, as a result of the control, when the engine rpm reaches close to the target rpm, the operations of the electronic throttles for a part of the cylinders are stopped, the electronic throttles for the rest of the cylinders are operated, and thus, control excellent in convergence and stability can be provided.

According to the first embodiment, a description has been given of the control for the idle rpm of the internal combustion engine, but the present invention is not limited to the target rpm control of the idle rpm, and is applicable to all cases where the control of the engine rpm toward the target rpm is necessary in the control of the internal combustion engine. Moreover, in a system such as a cruise control of controlling the electronic throttles so that the vehicle speed is maintained to be constant, the vehicle speed can be acquired based on the engine rpm, a gear ratio, a tire diameter, and the like, and hence, by applying the present invention, control excellent in stability and convergence can be provided.

According to the first embodiment, the control gains are set to independent and different values for the electronic throttles 11 and 12, but the configuration is not limited to this embodiment, and, for example, as long as sufficient responsiveness, stability, and convergence can be provided by setting the first dead zone and the second dead zone, and only by stopping the operation of one of the electronic throttles in the second dead zone, the control gains for the electronic throttle 11 and the electronic throttle 12 may be set to the same values.

According to the first embodiment, the control gains are acquired based on the same $\Delta NE$ for the case where the engine rpm is higher than the target rpm and the case where the engine rpm is lower than the target rpm, but, independent control gains are further acquired for each of the cylinders for the case where the engine rpm is higher than the target rpm and the case where the engine rpm is lower than the target rpm. Moreover, according to the first embodiment, the control gain is acquired by using the map, but the control gain may be acquired by calculation such as theoretical formulae.

Moreover, when the engine rpm is higher or lower than the second dead zone, the electronic throttles for both the cylinders are operated, but the electronic throttle of one of the cylinders may not be operated by changing the setting of the control gains.

According to the first embodiment, a description has been given of the case of the V-twin engine as an example, but the engine to which the present invention is applied is not limited to this type of engine. As long as an engine has at least two cylinders and electronic throttles for independently controlling respective cylinder groups, the present invention can be applied to the engine. In this case, a dead zone may be provided for each of the cylinders, and the number of the dead zones and the number of the cylinders may be the same. Alternatively, groups of a predetermined number of cylinders may be set, a dead zone may be set for each of the groups, and the number of the dead zones and the number of the groups may be the same.

What is claimed is:

1. A control device for an internal combustion engine for controlling an engine rpm of the internal combustion engine, the internal combustion engine including a plurality of cylinders and independently controllable electronic throttles for the respective cylinder, the control device comprising:

an engine rpm sensor configured to detect the engine rpm of the internal combustion engine; and a controller configured to:

set a target rpm based on an operation state of a vehicle in which the internal combustion engine is provided;

detect a difference between the target rpm and the engine rpm of the internal combustion engine; and independently control the plurality of electronic throttles based on a magnitude of the detected difference so as to increase or decrease an intake air amount so that the target rpm and the engine rpm of the internal combustion engine match each other, wherein the controller is further configured to:

set, to each of the electronic throttles, a respective dead zone in which the respective electronic throttle is prevented from being operated, wherein the respective dead zones have different ranges of the detected difference and are overlapping with one another;

determine, for the each of the plurality of the electronic throttles, whether or not the difference detected by the controller is in the respective dead zone set for the respective throttle;

in response to determining that one of the plurality of the electronic throttles has the difference in the dead zone, prevent the electronic throttle from operating; and in response to determining that one of the plurality of the electronic throttles has the difference exceeding the dead zone, determine a control gain for said one electronic throttle depending on the magnitude of the difference detected by the controller so as to operate the electronic throttle.

2. The control device for an internal combustion engine according to claim 1, wherein the controller independently sets the control gains for the respective plurality of electronic throttles.

3. The control device for an internal combustion engine according to claim 1, wherein:

the dead zone set to the each of the plurality of the electronic throttles includes a first dead zone and a second dead zone; and the controller sets the second dead zone to be a larger range than a range for the first dead zone, and sets a control gain for one of the plurality of the electronic throttles which is prevented from operating in the second dead zone to be a larger value than a value of a control gain for one of the plurality of the electronic throttles which is prevented from operating in the first dead zone.

4. The control device for an internal combustion engine according to claim 1, wherein the controller is further configured to:

set, based on the control gain, target values of the intake air amounts independently controlled by the respective plurality of the electronic throttles; and set again, when a difference between the target values of the intake air amounts exceeds a predetermined value, the target values so that the difference does not exceed the predetermined value.

5. The control device for an internal combustion engine according to claim 1, wherein the target rpm comprises a target rpm in an idle state.

6. The control method for an internal combustion engine for controlling an engine rpm of the internal combustion engine, the internal combustion engine including a plurality of cylinders and independently controllable electronic throttles for the respective cylinder, the control method comprising:

setting, to each of the electronic throttles, a respective dead zone in which the respective electronic throttle is prevented from being operated, wherein dead zones have different range values of a difference between a target rpm and the engine rpm of the internal combustion engine, from one another and are overlapping ranges with respect to one another;

setting the target rpm based on an operation state of a vehicle in which the internal combustion engine is provided;

detecting the difference between the target rpm and the engine rpm of the internal combustion engine;

determining, for the each of the electronic throttles, whether or not the detected difference is in the set, respective dead zone; and preventing one of the electronic throttles determined to have the difference in the respective dead zone from operating, and determining, for one of the electronic throttles determined to have the difference exceeding the dead zone, a control gain for the electronic throttle depending on the magnitude of the detected difference so as to operate the one of the electronic throttles.

7. The control device for an internal combustion engine according to claim 1, wherein:

the electronic throttles comprise a first throttle for which a first dead zone is set and a second throttle for which a second dead zone is set, the first dead zone is a smaller range of the detected difference than the second dead zone, the controller is further configured to set, based on the detected difference, a first control gain for the first throttle and a second control gain for the second throttle, the second control gain is a larger value than the first control gain in the detected difference outside of the dead zones, and the controller is configured to independently set the first control gain for the first throttle and the second control gain for the second throttle so as to independently control opening degrees of the first throttle and the second throttle.

8. The control method for an internal combustion engine according to claim 6, wherein:

the electronic throttles comprise a first throttle for which a first dead zone is set and a second throttle for which a second dead zone is set, the first dead zone is a smaller range of the detected difference than the second dead zone, the setting further comprises setting, based on the detected difference, a first control gain for the first throttle and a second control gain for the second throttle, the second control gain is a larger value than the first control gain in the detected difference outside of the dead zones, and the setting further comprises independently setting the first control gain for the first throttle and the second control gain for the second throttle so as to independently control opening degrees of the first throttle and the second throttle.

* * * * *